US010686247B2

(12) United States Patent
Yang et al.

(10) Patent No.: US 10,686,247 B2
(45) Date of Patent: Jun. 16, 2020

(54) HOLDER FOR PLANAR ANTENNA

(71) Applicants: SHENZHEN ANTOP TECHNOLOGY LIMITED (CN), Shenzhen (CN); Ruidian Yang, Shenzhen (CN)

(72) Inventors: Ruidian Yang, Shenzhen (CN); WeiMing Lu, Shenzhen (CN)

(73) Assignees: SHENZHEN ANTOP TECHNOLOGY LIMITED, Shenzhen (CN); Ruidian Yang, Shenzhen (CN)

( * ) Notice: Subject to any disclaimer, the term of this patent is extended or adjusted under 35 U.S.C. 154(b) by 121 days.

(21) Appl. No.: 15/877,893

(22) Filed: Jan. 23, 2018

(65) Prior Publication Data

US 2019/0006737 A1 Jan. 3, 2019

(30) Foreign Application Priority Data

Jun. 30, 2017 (CN) ..... 2017 1 0525629
Jun. 30, 2017 (CN) ..... 2017 2 0784255 U

(51) Int. Cl.
*H01Q 1/24* (2006.01)
*H01Q 9/04* (2006.01)
*H01Q 1/12* (2006.01)

(52) U.S. Cl.
CPC ..... *H01Q 1/24* (2013.01); *H01Q 1/1207* (2013.01); *H01Q 9/04* (2013.01); *H01Q 9/0407* (2013.01)

(58) Field of Classification Search
CPC ..... H01Q 1/24; H01Q 9/0407; H01Q 9/04; H01Q 1/1207
USPC ..... 343/878
See application file for complete search history.

(56) References Cited

U.S. PATENT DOCUMENTS

2012/0169558 A1* 7/2012 Huang ..... G01R 31/002 343/766
2013/0092813 A1* 4/2013 He ..... H01Q 1/1228 248/512
2013/0313380 A1* 11/2013 Yang ..... H01Q 1/1242 248/123.2
2017/0033463 A1* 2/2017 Tinaphong ..... H01Q 1/1207

* cited by examiner

*Primary Examiner* — Hai V Tran
(74) *Attorney, Agent, or Firm* — Muncy, Geissler, Olds & Lowe, P.C.

(57) ABSTRACT

A holder for planar antenna comprising a base and a support, the base being provided with a location hole and an assembly hole in consistent with a bottom portion of the support, a vertical opening being disposed on a top of the support and a horizontal opening being disposed at a side of the support. When the holder is placed on a table top, the antenna is inserted into the vertical opening. When the holder is hang onto a wall, the antenna is inserted into the horizontal opening. Compared to conventional holders, the providing of the horizontal and vertical openings facilitates both hanging the holder to the wall and placing on a table top, which is convenient for both indoor and outdoor use. The supports and the base are detachable, facilitating storage and transport.

9 Claims, 5 Drawing Sheets

HOLDER FOR PLANAR ANTENNA

TECHNICAL FIELD

The present invention related to the installation of a planar antenna, and in particular, to a holder for planar antenna.

BACKGROUND

Planar antennas available on the market are generally designed for hanging on a wall or placing on a table top. The strength of wireless signals, however, may vary from area to area. In the event that signal strength is better at higher elevation, it is desirable to hang the planar antenna on the wall. In contrast, sometimes it is better for the planar antennas to be placed on a table top to receive the wireless signal. Furthermore, one has to use a planar antenna designed for placing on a table top when he/she is in the open air. It is therefore in an urgent need to achieve better signal receiving and convenient use of planar antennas in different environments.

SUMMARY

A holder for planar antenna is provided by the present invention, which could be adapted for multiple environments while receiving stronger signal.

A holder for planar antenna comprising a base and a support, the base being provided with a location hole and an assembly hole in consistent with a bottom portion of the support, a vertical opening being disposed on a top of the support and a horizontal opening being disposed at a side of the support. When the holder is placed on a table top, the antenna is inserted into the vertical opening. When the holder is hang onto a wall, the antenna is inserted into the horizontal opening.

Compared to conventional holders, the providing of the horizontal and vertical openings facilitates both hanging the holder to the wall and placing on a table top, which is convenient for both indoor and outdoor use. The supports and the base are detachable, facilitating storage and transport.

The support includes a recess portion and two arms extending laterally from the recess portion to form a U-shape. The vertical opening is provided at the top of the arm and the horizontal opening is disposed at an upper portion of the support, spanned horizontally the recess portion and extended into the two arms.

When the holder is horizontally placed on a table top, the planar antenna could be inserted into the vertical openings with the arms supporting the antenna. When the holder is hang on a wall, the planar antenna could be inserted into the horizontal openings with the recess portion and two arms jointly supporting the antenna. Compared to supporting the antenna only with the arms, larger contact area can be obtained which is favorable for force distribution and improvement of structure stability. When the holder is hang onto a wall, the further the horizontal opening spaced from the bottom of the support, the further the point of action on the support by the planar antenna spaced from the bottom of the support. Therefore, according to the level principle, the longer the level, the bigger the force applied on the pivot (i.e., the contact portion between the bottom of the support and the assembly hole). Therefore, more force will be needed to overcome the sliding friction force, indicating that it is more difficult for the support to disengage with the assembly hole.

Further, any of the two arms forms an angle of 80° to 89° with a frontal plane and expands externally. In this way, the two arms are spaced at a distance gradually increases in the direction away from the recess portion. This means that the two arms expand externally from the recess portion such that the interaction force between the planar antenna and the holder is dispersed, which facilitates supporting bigger antenna. The angle shall not be too small since this would results in longer distance between the two arms and thus larger tension forces applied thereon, causing reduced structural stability and service life.

Further, any of the two arms forms an angle of 80° to 89° with a horizontal plane and expands externally. The distance between the two arms (or a U-shaped structure) increases from bottom to top. In this way, the vertical opening is inclined to the planar antenna when assembled, which increases the horizontal contact area between the vertical opening and the antenna and reduces the force applied thereon. If, however, the angle is too small, the arms would be spaced at a very large distance, which results in larger tension on the arms, leading to reduced structural stability and service life.

The support is further provided with a reinforcing element connecting the two arms. This is done because the U-shaped arms would be subject to stress over time and ultimately lead to irreversible damage to the arms. The providing of the reinforcing element improves the stability of the U-shaped structure and forms a closed polygon structure such that forces could be dispersed and conducted on the support. When the holder is hang on the wall, the reinforcing element could be used as one of the supporting elements for amounting the support to the base. When the holder is placed on a table top, the reinforcing element enlarges the contact area between the support and the base, reducing the stress to a certain extent.

The top of the reinforcing element forms as a shallow U-shape concaved downward, such that the angle formed between the reinforcing element and the support is larger than 90°, which prevents possible deformation during demolding. A smaller angle makes it more difficult to achieve desired configuration. The U-shape enables the reinforcing element to have a larger contact area with the support, which means the joint therebetween is stable. Since the support is inserted into the assembly hole, the reinforcing element is substantially not subject to stress from lateral sides. Therefore, the reduced width in the middle part does not substantially affect the use of the product, while reducing material consumption.

Further, the base is extended downward to form a body portion such that a cavity is formed in the base. In the cavity is disposed from top to bottom an iron weight and a slide-proof element. An iron weight could be disposed in the cavity to make the holder not easy to move, such that the holder, support and planer antenna could be fixed together more tightly. The slide-proof element is provided to seal the cavity such that dust would not enter into the cavity and the contact area between the holder and the table top is increased. This would also reduce the pressure caused to the wall or the table top and thus prevent them from deformation and damage. Meanwhile, the slide-proof element could to some extent increase the friction between the holder and the wall.

Further, the location hole is disposed on the base at a side of the horizontal opening. When the holder is hang onto a wall, the location hole is engaged with a nail disposed on the wall. That is, the contact portion between the location hole and the nail serves as a pivot for the holder. When the planar antenna is inserted on the horizontal opening, the gravity of the pivot is displaced greatly, which applies a force to the wall through the opposite bottom portion of the base. In this way, the opposite bottom portion of the base has a greater contact area with the wall, so that the pressure between the holder and the wall could be reduced, which facilitate improvements of structural stability and service life.

Further, each of two sides of the vertical opening forms a first angle of 85° to 89° with a horizontal plane and extends externally. The diminished width of each opening facilitates the tight fit with the antenna, preventing it from sliding out of the opening. The wider width of the opening facilitates easy insertion of the antenna and prevents occurrence of frictions between the support and the antenna that may cause damages to the support or the antenna. Further, the inclined sides of the openings provide supporting portions for the antenna, in addition to the arc portion. The force applied onto the contact portions between the openings and the antenna is distributed, leading to decreased pressure, improved stability and extended service life.

Further, each of two sides of the horizontal opening forms a second angle of 84° to 88° with a frontal plane and extends externally, and wherein the second angle is less than the first angel. The diminished width of each opening facilitates the tight fit with the antenna, preventing it from sliding out of the opening. The wider width of the opening facilitates easy insertion of the antenna and prevents occurrence of frictions between the support and the antenna that may cause damages to the support or the antenna. Further, the inclined sides of the openings provide supporting portions for the antenna, in addition to the arc portion. The force applied onto the contact portions between the openings and the antenna is distributed, leading to decreased pressure, improved stability and extended service life.

Further, the holder comprises two supports, and correspondingly two assembly holes, and wherein the two supports are spaced by a distance of 80 to 150 mm. A planar antenna has a width generally within 150 mm to 400 mm. A distance (e.g. 80 mm) as short as less than one fourth of the 400 mm can sufficiently support an antenna having a width of 400 mm. Whether a holder can firmly support an antenna depends on the size and weight of the antenna. In view that the antenna is generally light, it is difficult to firmly support the antenna even it has a big size. Therefore, it is desirable that the distance between the supports to be at least 80 mm. On the other hand, it is not possible to support a planar antenna with a small size by using widely spaced supports. Therefore, the distance is set to be within 150 mm so as to accommodate various antennas.

Further, the assembly hole is provided with two plugs and correspondingly the support is provided with two recesses, such that an increased contact area is achieved between the assembly hole and the support. It is supposed that the plugs and the recesses would have some rough surfaces at edges after demolding, which is favorable for increase of friction ecoefficiency such that the plugs are not easy to slide within the recesses.

Compared to the holder conventionally available, the invention described herein is advantageous in terms of the following aspects.

(i) The holder is adaptive for horizontal placement on a table top and hanging onto a wall, indoor or outdoor, with great flexibility. The support and the base are capable of being assembled by insertion, which is convenient for detachments and assembly.

(ii) The two arms form an angle of 80° to 89° with the frontal plane and an angle of 80° to 89° with the horizontal plane, and both expand externally. This means that the interaction force between the planar antenna and the holder is dispersed, which facilitates supporting bigger antenna.

(iii) The reinforcing element forms a closed polygon structure with the U-shaped structure of the support and the reinforcing element has a shallow U-shaped top, which improves the stability of the support.

(iv) The horizontal opening is disposed away from the bottom of the support, and the plugs and recesses both increase the contact area between the support and the base, which decreases the pressure applied onto the material and improves the service life of the holder. In the meantime, the support is not prone to slid out of the base.

(v) The two sides of the vertical opening form an angle of 85° to 89° with the horizontal plane and the two sides of the horizontal opening form an angle of 84° to 88° with the horizontal plane, and both expand externally. At both openings an arc portion extending downwardly is provided, which helps to accommodate various planar antenna with irregular edges.

DETAILED DESCRIPTION OF THE INVENTION

Figure 1:
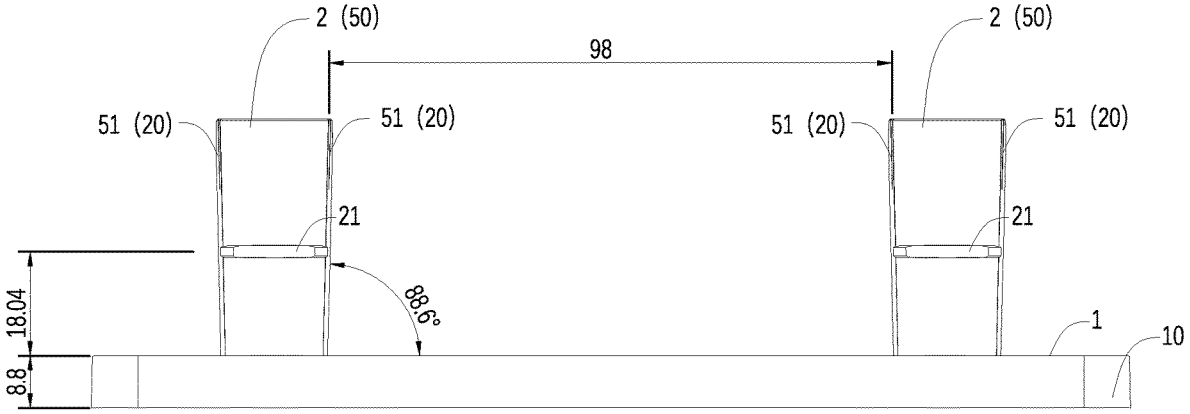
FIG. 1 is a front view of a horizontally orientated holder.

The invention will now be described in more detail with reference to specific examples and drawings.

FIGS. 1 to 6 show a holder for planar antenna according to the present invention. The holder comprises a base 1 and two supports 2. Two location holes 3 and assembly openings 4 in consistent with the bottoms of the supports 2 are provided on the base 1. On each of the supports 2 is provided a vertical opening 20 at the top and a horizontal opening 21 at one side.

The providing of the horizontal and vertical openings facilitates both hanging the holder to the wall and placing on a table top, which is convenient for both indoor and outdoor use. The supports 2 and the base 1 are detachable, facilitating storage and transport.

The support 2 includes a recess portion 50 and two arms 51 extending laterally from the recess portion 50 to form a U-shape. The location holes 3 are located within an area defined by the recess portion 50 and the two arms 51. The vertical opening 20 is provided at the top of the arm 51 and the horizontal opening 21 is disposed at the middle of the support 2 and spanned horizontally the recess portion 50 into the two arms 51. When the holder is horizontally placed on a table top, the planar antenna could be inserted into the vertical openings 20 with the U-shaped arms supporting the antenna. When the holder is hang on a wall, the planar antenna could be inserted into the horizontal openings 21 with the recess portion 50 and two arms 51 jointly supporting the antenna. Compared to supporting the antenna only with the arms 51, larger contact area can be obtained which is favorable for force distribution and improvement of structure stability. It is shown as an example in FIG. 3 that the arm 51 forms an angle of 88° with the frontal plane and expands externally. This means that the two arms expand externally from the recess portion 50 such that the interaction force between the planar antenna and the holder is dispersed, which facilitates supporting bigger antenna. Since the location hole 3 is within an area defined by the recess portion 50 and the two arms 51, when the holder is hang on a wall, the force applied on the holder is within the location holes without applying deformation to other parts of the holder. The angle, on the other hand, shall not be too small since this would results in longer distance between the two arms 51 and thus larger tension forces applied thereon, causing reduced structural stability and service life.

FIG. 1 shows that the two arms 51 form an angle of 88.6° with the horizontal plane and extend externally, i.e., the distance between the two arms 51 increases from bottom to top. In this way, the vertical opening 20 is inclined to the planar antenna when assembled, which increases the horizontal contact area between the vertical opening 20 and the antenna and reduces the force applied thereon. Since this degree of angle (88.6°) is very close to 90°, the pressure resistance of the support 2 would not be negatively affected while achieving more distributed force application on the antenna. If, however, the angle is too small, the arms 51 would be spaced at a very large distance, which results in larger tension on the arms 51, leading to reduced structural stability and service life.

The support 2 is further provided with a reinforcing element 23 connecting the two arms 51. This is done because the U-shaped arms would be subject to stress over time and ultimately lead to irreversible damage to the arms. The providing of the reinforcing element 23 improves the stability of the U-shaped structure and forms a closed polygon structure such that forces could be dispersed and conducted on the support 2. When the holder is hang on the wall, the reinforcing element 23 could be used as one of the supporting elements for amounting the support 2 to the base 1. When the holder is placed on a table top, the reinforcing element 23 enlarges the contact area between the support 2 and the base 1, reducing the stress to a certain extent.

The top of the reinforcing element 23 forms as a shallow U-shape concaved downward, such that the angle formed between the reinforcing element 23 and the support 2 is larger than 90°, which prevents possible deformation during demolding. A smaller angle makes it more difficult to achieve desired configuration. The U-shape enables the reinforcing element 23 to have a larger contact area with the support 2, which means the joint therebetween is stable. Since the support 2 is inserted into the assembly hole 4, the reinforcing element 23 is substantially not subject to stress from lateral sides. Therefore, the reduced width in the middle part does not substantially affect the use of the product, while reducing material consumption.

The base 1 is extended downward to form a body portion 10 such that a cavity is formed in the base 1. When the holder is hang onto a wall or placed on a table top, a weight could be disposed in the cavity to make the holder not easy to move, such that the holder 1, support 2 and planer antenna could be fixed together more tightly. The body portion 10 also prevents dust from entering into the base 1, therefore facilitating cleaning and maintenance.

The horizontal opening 21 is disposed away from the bottom of the support 2. When the holder is hang onto a wall, the further the horizontal opening 21 spaced from the bottom of the support 2, the further the point of action on the support 2 by the planar antenna spaced from the bottom of the support 2. Therefore, according to the level principle, the longer the level, the bigger the force applied on the pivot (i.e., the contact portion between the bottom of the support 2 and the assembly hole 4). Therefore, more force will be needed to overcome the sliding friction force, indicating that it is more difficult for the support 2 to disengage with the assembly hole 4.

The location hole 3 is disposed on the base 1 at a side in the direction of the horizontal opening 21. When the holder is hang onto a wall, the location hole 3 is engaged with a nail 6 disposed on the wall. That is, the contact portion between the location hole 3 and the nail 6 serves as a pivot for the holder. When the planar antenna is inserted on the horizontal opening 21, the gravity of the pivot is displaced greatly, which applies a force to the wall through the opposite bottom portion of the base. In this way, the opposite bottom portion of the base has a greater contact area with the wall, so that the pressure between the holder and the wall could be reduced, which facilitate improvements of structural stability and service life.

As FIG. 1 shows, the horizontal opening 21 is spaced from the base 1 by a distance of 18 mm, and the depth of the assembly 4 is comparable with the height of the body portion 10 (both are about 8.8 mm). Assumed that the planar antenna is weighted 150 g (generally weighted between 100 and 300 mg, 10 kg max.), and the gravity coefficient is 9.8n/kg, therefore the force of gravity applied on the horizontal opening 21 by the planar antenna is 1.47 N. According to the level balance condition, 1.47N×18 mm=F1×4.4 mm, wherein 4.4 mm is an intermediate value of the depth of the assembly hole and F1 is the force applied by the support 2 onto the body portion 10, and thus F1 is 6N. The holder is generally made of conventional plastics. It is assumed that the holder is made of ABS resin with a coefficient of dynamic friction of about 0.5. Thus, the force to overcome the friction between the support 2 and the assembly hole 4 would at least be 6N*0.5=3N which is approximately the weight of six eggs. Except for violent shake of the wall in the horizontal direction, it is not possible to obtain such as big force during normal use of the holder to remove the support 2 from the assembly hole 4.

An arc portion 24 extending downwardly is provided at each bottom of the horizontal and vertical openings 21, 20. The arch portion 24 prevents problems associated with demolding that may cause unstable structures due to errors and deformations. The arc shape, in contrast to a square edge, distributes stress and prevents from deformation. The arch shape also helps to accommodate various planar antenna with irregular edges.

Figure 2:
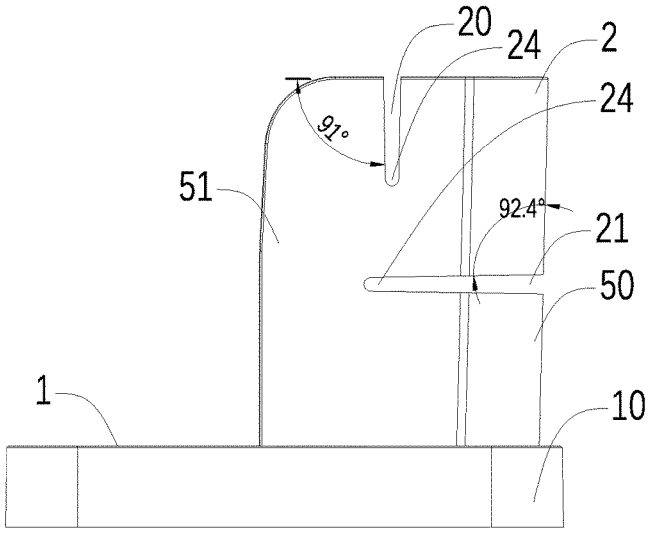
FIG. 2 is a left view of the holder.
Figure 3:
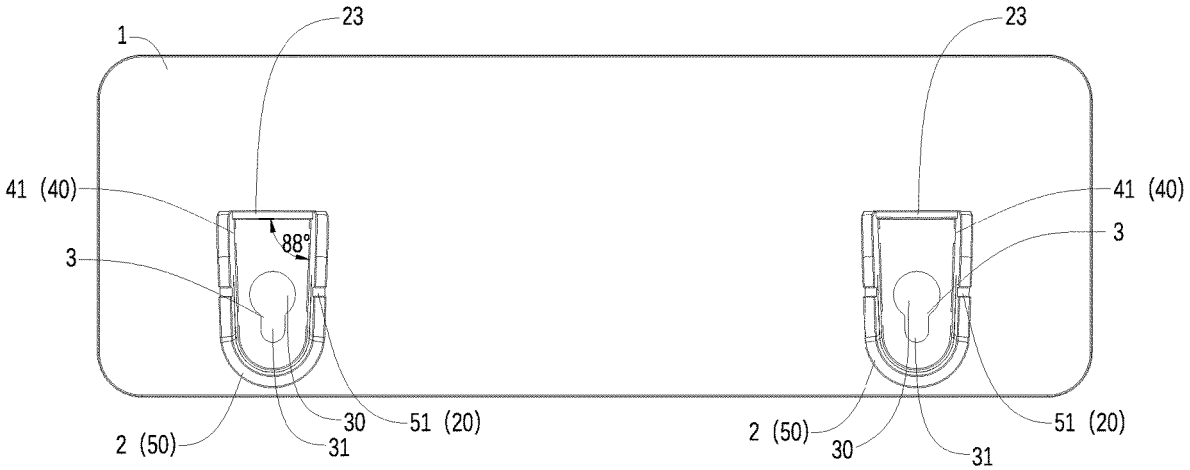
FIG. 3 is a top view of the holder.
Figure 4:
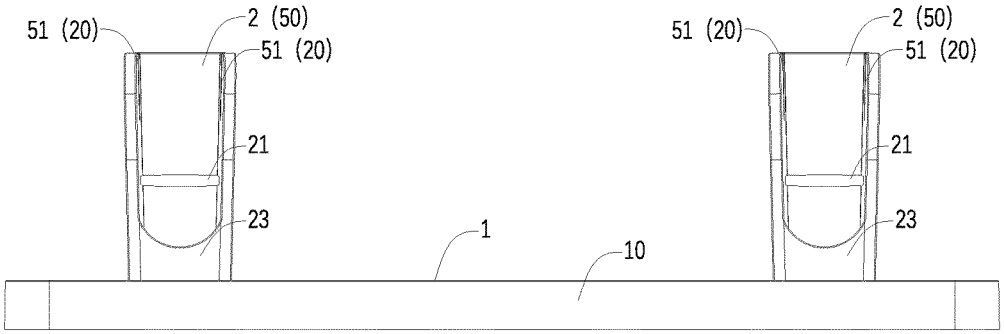
FIG. 4 is a rear view of the holder.
Figure 5:
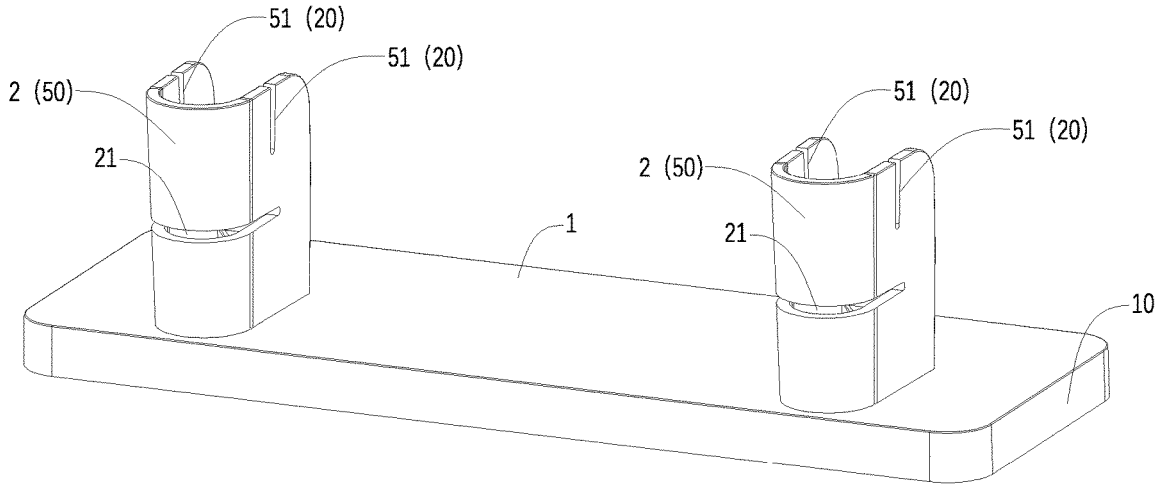
FIG. 5 is a perspective view of the horizontally orientated holder.
Figure 6:
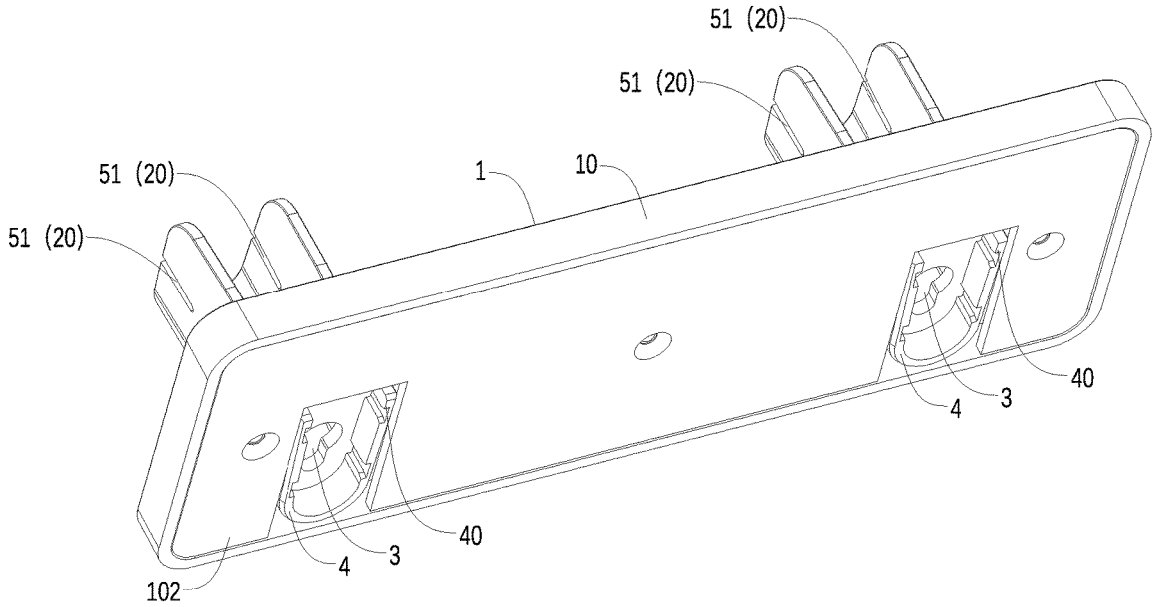
FIG. 6 is a rear perspective view of the horizontally orientated holder.

As shown in FIG. 2, each of the two sides of the vertical opening forms a first angle of 85° to 89° with the horizontal plane and each of the two sides of the horizontal opening form a second angle of 84° to 88° with the horizontal plane and all these sides extend externally. That is, the widths of the openings diminish from top to bottom. But as both the first and second angles are very close to 90°, the magnification of the diminishment is actually small such that these openings 20, 21 have depths enough to firmly receive the planar antenna.

The diminished width of each opening 20, 21 facilitates the tight fit with the antenna, preventing it from sliding out of the opening. The wider width of the opening facilitates easy insertion of the antenna and prevents occurrence of frictions between the support 2 and the antenna that may cause damages to the support 2 or the antenna. Further, the inclined sides of the openings 20, 21 provide supporting portions for the antenna, in addition to the arc portion 24. The force applied onto the contact portions between the openings and the antenna is distributed, leading to decreased pressure, improved stability and extended service life.

The assembly hole 4 is provided with two plugs 40 and correspondingly the support 2 is provided with two recesses 41, such that an increased contact area is achieved between the assembly hole 4 and the support 2. It is supposed that the plugs 40 and the recesses 41 would have some rough surfaces at edges after demolding, which is favorable for increase of friction ecoefficiency such that the plugs are not easy to slide within the recesses.

Figure 9:
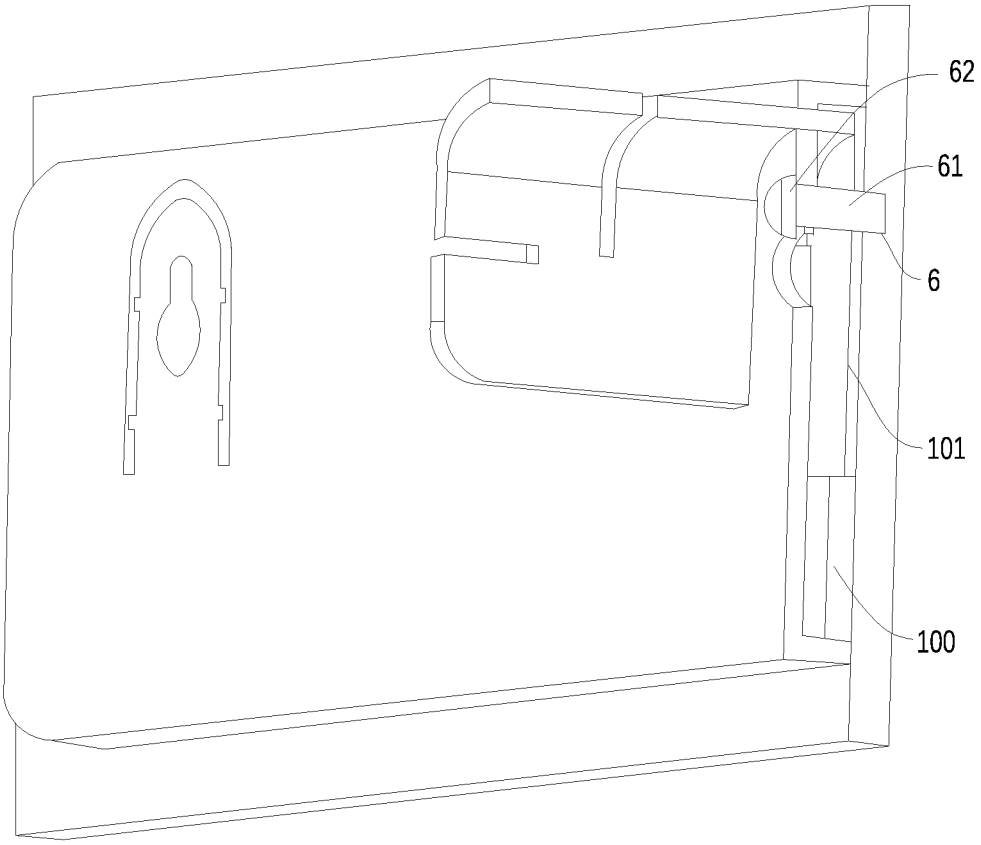
FIG. 9 is a sectional view showing the holder is in use on a wall.

In an example, the location hole 3 includes a wide hole 30 and a narrow hole 31, with the narrow hole 31 disposed at one side of the horizontal opening 21 and the wide hole 30 at the opposite side. As shown in FIG. 9, in the cavity of the body portion 10 is disposed with an iron block 100 such that the holder is not easy to move. This would improve the stability of the whole assembly. A slide-proof element 101 is provided to seal the cavity such that dust would not enter into the cavity and the contact area between the holder and the table top is increased. This would also reduce the pressure caused to the wall or the table top and thus prevent them from deformation and damage. Meanwhile, the slide-proof element 101 could to some extent increase the friction between the holder and the wall.

The present invention works as follows.

Figure 7:
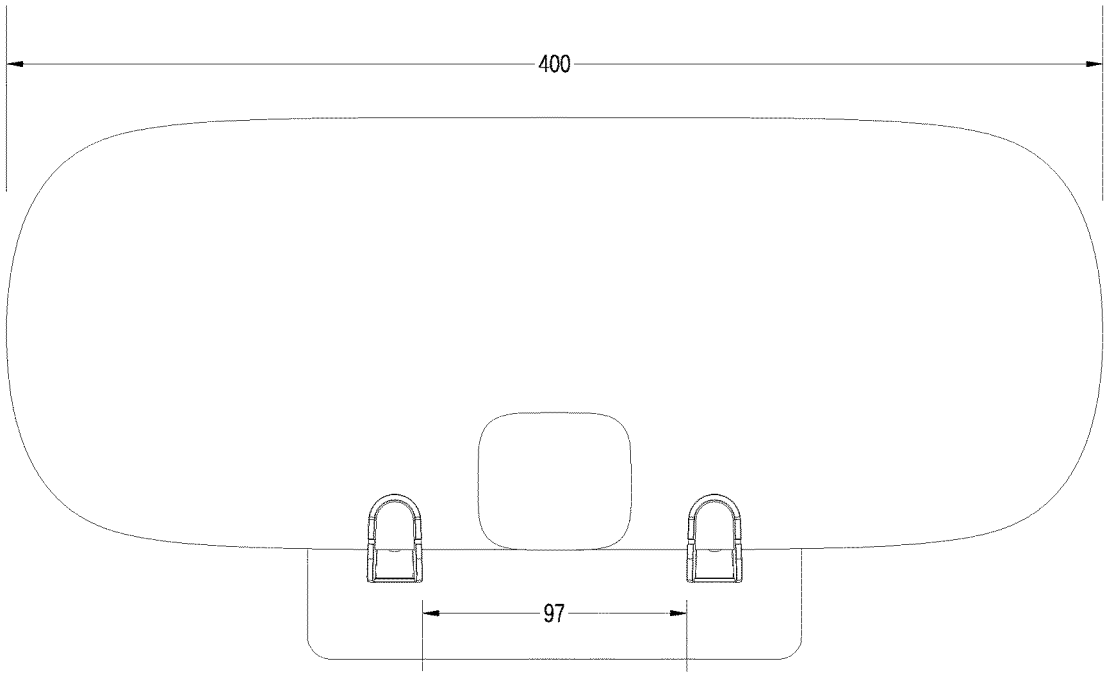
FIG. 7 is a schematic view showing the holder is in use on a wall.

As shown in FIG. 7, when the holder is to be hang onto a wall, two nails 6 should be disposed on the wall to correspond to the two location holes 3. The wide hole 30 is then penetrated by the nail body 61 through the nail head 62. By action of gravity, the nail body 61 would be fixed within the narrow 31. The two supports 2 are inserted into the assembly holes 4 and then the planar antenna is inserted into the horizontal openings 21.

FIG. 7 shows that the distance between the two supports 2 is 97 mm. The antenna has a width of 400 mm. The two supports spaced by this distance could sufficiently support the antenna with 400 mm width. A planar antenna has a width generally within 150 mm to 400 mm. Whether a holder can firmly support an antenna depends on the size and weight of the antenna. In view that the antenna is generally light, it is difficult to firmly support the antenna even it has a big size. Therefore, it is desirable that the distance between the supports 2 to be at least 80 mm. On the other hand, it is not possible to support a planar antenna with a small size by using widely spaced supports. Therefore, in consideration of the adaptability of the holder, the distance shall not be set too long. In this example, the distance between the two supports is set to be 97 mm to accommodate various planar antennas.

Figure 8:
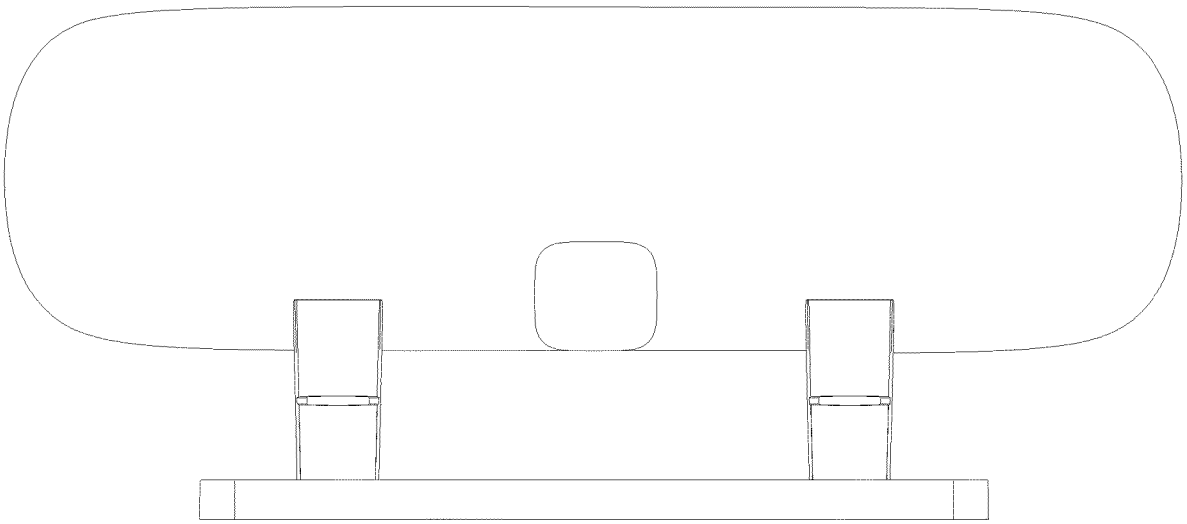
FIG. 8 is a schematic view showing the holder is in user on a table top.

As shown in FIG. 8, when the holder is to be placed on a table top, the base 1 is placed on the table top. The supports 2 are inserted into the two assembly holes 4 and then the planar antenna is inserted into the vertical openings 20.

The holder provided herein could be used indoor for at least 3 years, superior to conventional holders which have a two-year service life affected by problems including material deformation.

What is claimed is:

1. A holder for planar antenna comprising a base and a support, the base being provided with a location hole and an assembly hole in consistent with a bottom portion of the support, wherein a vertical opening is disposed on a top of the support and a horizontal opening is disposed at a side of the support;

wherein the base is extended downwardly to form a body portion such that a cavity is formed in the base, and in the cavity is disposed from top to bottom an iron weight and a slide-proof element.

2. The holder for planar antenna of claim 1, wherein the support includes a recess portion and two arms extending externally from both sides of an opening of the recess portion, the vertical opening being provided at a top of the arms, and the horizontal opening being disposed at an upper portion of the support, spanning horizontally the recess portion and extending into the two arms.

3. The holder for planar antenna of claim 2, wherein any of the two arms forms an angle of 80° to 89° with a frontal plane and expands externally.

4. The holder for planar antenna of claim 2, wherein any of the two arms forms an angle of 80° to 89° with a horizontal plane and expands externally.

5. The holder for planar antenna of claim 2, wherein the support is provided with a reinforcing element connecting the two arms, and a top of the reinforcing element forms as a U-shape concaved downwardly.

6. The holder for planar antenna of claim 1, wherein the location hole is disposed on the base at a side of the horizontal opening.

7. The holder for planar antenna of claim 1, wherein each of two sides of the vertical opening forms a first angle of 85° to 89° with a horizontal plane and extends externally.

8. The holder for planar antenna of claim 7, wherein each of two sides of the horizontal opening forms a second angle of 84° to 88° with a frontal plane and extends externally, and wherein the second angle is less than the first angle.

9. The holder for planar antenna of claim 1, wherein the holder comprises two supports, and correspondingly two assembly holes, and wherein the two supports are spaced by a distance of 80 to 150 mm.

* * * * *